US006502357B1

(12) United States Patent
Stuthman et al.

(10) Patent No.: US 6,502,357 B1
(45) Date of Patent: Jan. 7, 2003

(54) PVC WALL PANEL SYSTEM

(75) Inventors: Thomas Stuthman, Taylorville, IL (US); Brian Dust, Assumption, IL (US); Corey Knight, Assumption, IL (US); Eugene Pollock, Assumption, IL (US)

(73) Assignee: The GSI Group, Assumption, IL (US)

( * ) Notice: Subject to any disclaimer, the term of this patent is extended or adjusted under 35 U.S.C. 154(b) by 0 days.

(21) Appl. No.: 09/512,530

(22) Filed: Feb. 24, 2000

(51) Int. Cl.[7] ..... E04H 1/00

(52) U.S. Cl. ..... 52/241; 52/93; 52/627; 52/586; 52/239; 52/493; 52/522; 52/783.19; 403/405.1; 287/189.36

(58) Field of Search ..... 52/214, 793.11, 52/800.1, 800.12, 592.1, 592.2, 800.15, 800.17, 768, 730.1, 730.3, 734.2

(56) References Cited

U.S. PATENT DOCUMENTS 3,252,260 A * 5/1966 Mills ..... 52/497
3,261,625 A * 7/1966 Cripe ..... 287/189.36
3,363,372 A * 1/1968 Raynes ..... 52/93
3,386,221 A * 6/1968 Giovannucci ..... 52/586
3,416,282 A * 12/1968 Daugherty ..... 52/627
4,258,520 A * 3/1981 Rehbein ..... 52/522
5,474,402 A * 12/1995 Wu ..... 403/405.1
5,724,779 A * 3/1998 Chang ..... 52/239
5,875,596 A * 3/1999 Muller ..... 52/239
6,085,485 A * 7/2000 Murdock ..... 52/783.19

OTHER PUBLICATIONS

80/20 The Industrial Erector Set, 1998, 80/20 Inc., Catalog No. 0498, 300.*

* cited by examiner

*Primary Examiner*—Carl D. Friedman
*Assistant Examiner*—Steve Varner
(74) *Attorney, Agent, or Firm*—Polster, Lieder, Woodruff & Lucchesi

(57) ABSTRACT

A wall panel system of the present invention includes a plurality of inter-connecting tongue-and-groove panels which are framed by top, bottom, and side channel members to form walls which may be easily erected and taken down. The bottom channel member has a back leg, a front leg, and a bottom surface extending between the back and front legs. The top channel member can either be an integral, one-piece assembly or a two-piece assembly. In the one piece assembly, the top channel member is substantially similar to the bottom channel member. The two piece top channel member includes a fixed member and a locking leg mountable to the fixed member. The fixed member includes a back leg, an upper surface, and a rearwardly facing groove in the upper surface. The locking leg includes a finger which is received in the groove. The locking leg can have either a single panel or have or a pair of spaced apart arms. The locking leg extends down from the fixed member when mounted to the fixed member to define a front leg of the top channel member. Fasteners are used to secure the single panel locking member to the wall panel. When the double-arm locking leg is used, fasteners are not required.

30 Claims, 6 Drawing Sheets

PVC WALL PANEL SYSTEM

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to panel systems, and in particular, to a PVC panel system which can be used to easily erect non-load bearing walls, for example in animal enclosures. Although the invention is described to wall panel systems for use with animal enclosures, the broader applicability of the invention will be apparent to those skilled in the art.

Animal enclosures, such as farrowing pens, and other walls in hog houses, are often made of wood. The wood walls have to be framed with wood studs. The wall frame then must be covered, for example, with sheets of plywood. This is a time consuming, and hence, expensive procedure. Further, wood is porous. The dirt from, for example, a hog house, can become lodged in the ply wood wall, even if the wall is painted. It is thus difficult to keep the walls clean, and hence sanitary, even when painted. Further, the painted walls will need to be repainted periodically. Additionally, animals often like to chew on wood, requiring the replacement of portions of walls. Furthermore, the use of typical stud walls does not allow for quick and easy removal of the walls, should it be decided to partition the space differently within a hog house.

BRIEF SUMMARY OF THE INVENTION

A wall panel system of the present invention includes a plurality of inter-connecting panels which are framed by top, bottom, and side channel members. The panels are tongue and groove panels, and have a tongue extending from one side of the panel and a groove formed in the opposite side of the panel. The panel is preferably hollow, and includes a plurality of dividers which define chambers within the panel.

The bottom channel member has a back leg, a front leg, and a bottom surface extending between the back and front legs. In one variation, the bottom channel member includes a heel extending rearwardly from the back leg of the bottom channel member.

The top channel member can either be an integral, one-piece assembly or a two-piece assembly. In the one piece assembly, the top channel member includes a back leg, a front leg, and an upper surface extending between the back and front wall. The one-piece top channel member can also have a heel extending forwardly from the channel member's front leg.

The two piece top channel member includes a fixed member and a locking leg mountable to the fixed member. The fixed member includes a back leg, a top surface, and a rearwardly facing groove at the free end of the top surface. The locking leg includes a finger which is received in the groove. In a first embodiment, the locking leg includes a single panel which extends down from the fixed member when mounted to the fixed member. When this embodiment is used, fasteners are driven through the locking leg and into the panel to secure the locking leg in place. Preferably, the fasteners are driven through the joints between the panels, so that the fasteners are driven through the tongues and grooves of adjacent panels.

In an alternate embodiment, the fixed member has a pair of generally parallel grooves. The locking leg has a pair of parallel arms, each of which has a finger which is received in the fixed member groove. When this embodiment is used, connection of the locking leg to the fixed member will substantially prevent the fixed member from moving relative to the fixed member and panel, and fasteners are not required. The locking leg can, for example be generally "U"-shaped, "V"-shaped, or "y"-shaped. It can also be shaped generally like a "4" or an inverted "h".

The side channel members are used to secure the wall made from the system to side walls in the room in which the wall is being erected. The top and bottom channel members are used to form the side channel members. The first side channel member can be made from either the top or bottom channel members. The second side channel member is preferable made from the top two-piece top channel member.

A method of assembling a wall from the components is also disclosed.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention. It describes several embodiments, adaptations, variations, alternatives and uses of the invention, including what we presently believe to be the best mode of carrying out the invention.

Figure 1:
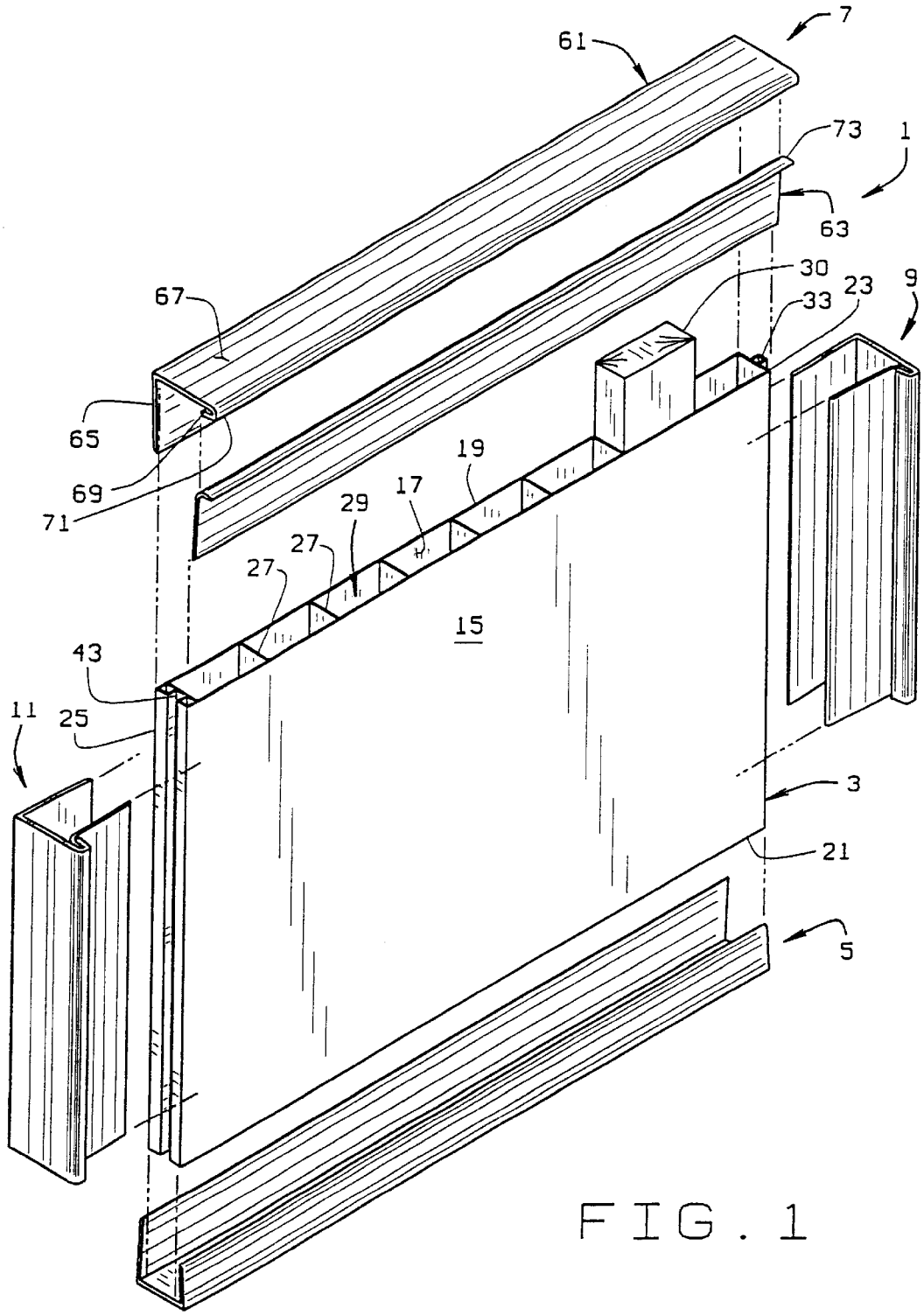
FIG. 1 is a perspective exploded view showing the components of an illustrative embodiment of a wall panel system of the present invention.
Figure 2:
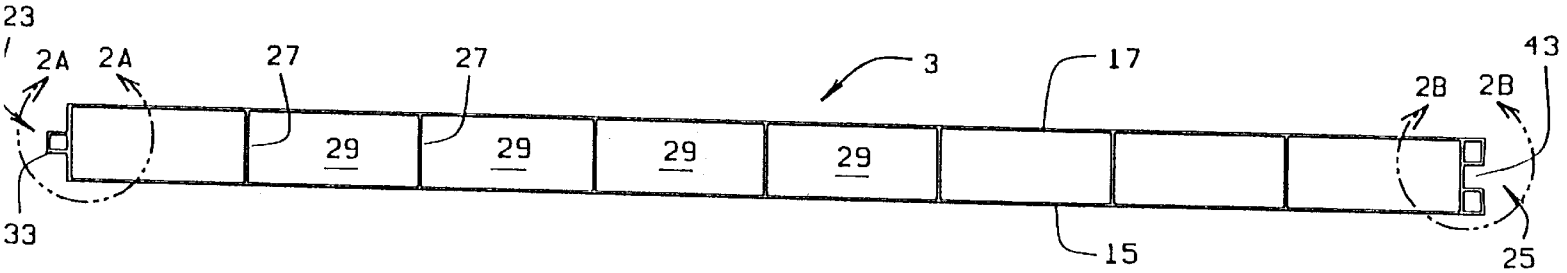
FIG. 2 is a top plan view of the wall panel of the system.

An illustrative portion of the wall panel system 1 of the present invention is shown generally in FIG. 1. The wall panel system 1 includes a plurality of wall panels 3 (only one of which is shown in FIG. 1) which are connected as described below. The wall panels 3 are framed by a bottom channel member 5, a top channel member 7, a right end channel member 9, and a left end channel member 11. As shown in FIG. 1, the right and left end channels are identical to the top channel member 7. The individual panels 3 are about 32" wide and can have any desired height. For example, they can extend fully between a floor and ceiling, or they can be gate height (i.e., three to four feet). The bottom and top channel members can also be about 32" long. However, if desired, they can be longer or shorter than the wall panels 3. The side channel members 9 and 11 have a length sufficient to span the distance between the top and bottom channel members. Preferably, the wall panel 3 and the channel members 5, 7, 9, and 11 are all made from polyvinyl chloride (PVC). They can then be easily formed, for example by an extrusion or similar process. Because the components are made from PVC, they are not porous, as is wood, for example. Thus, dirt from an animal enclosure will not penetrate the surface of walls built with the wall panel system, and the walls can be easily cleaned. Further, PVC panels have an unsatisfying taste to animals, such as hogs. Thus, animals will not chew through the panels as readily as they would, for example, through wood panels. The PVC preferably also includes ultraviolet light inhibitors to protect the components from deterioration from sunlight and flame retardants. The PVC components can also be provided with other additives to give the wall panel system other desired qualities.

The components of the wall panel system 1 are assembled, as described below, to form walls, fences, dividers, or the like to divide a large room or space into smaller sections. For example, in the case of a hog house, the wall panel system can be used to separate farrowing pens from nursery pens. As described below, the assembled walls can be easily taken down to rearrange the way in which the space is divided.

The wall panel 3 has a front surface 15, a back surface 17, a top edge 19, a bottom edge 21, a tongue side 23, and a groove side 25. The front and back surfaces are spaced from each other, and a plurality of dividers 27 extend between the front and back surfaces 15 and 17. The dividers 27, in conjunction with the front and back surfaces 15 and 17, define chambers 29 which are sized to receive reinforcing boards 30, such as 2×4 boards. The panel chambers 29 are sized so that the boards 30 can be easily slipped into the chambers, but will not move around much in the chambers.

Figure 3:
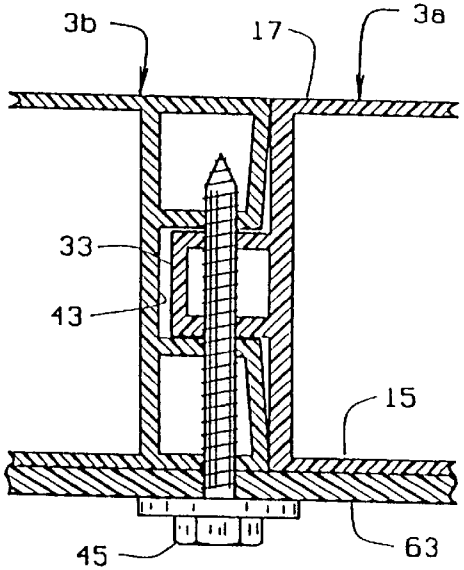
FIG. 3 is a cross-sectional view showing the connection of two panels to each other.
Figure 2B:
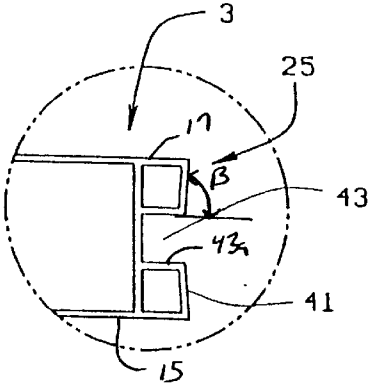
FIG. 2B is an enlarged fragmentary view of the groove end of the panel taken along line 2B—2B of FIG. 2.
Figure 2A:
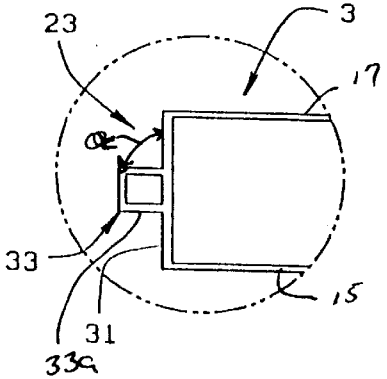
FIG. 2A is an enlarged fragmentary view of the tongue end of the panel taken along line 2A—2A of FIG. 2.

The tongue side 23 has an end surface 31 (FIG. 2A) from which a tongue 33 extends. Preferably, the tongue 33 extends the full length of the tongue side 23. The groove side 25 has an end surface 41 (FIG. 2B) in which a groove 43 is formed. The tongue 33 and groove 43 are sized so that the tongue 33 of a panel 3*a* will be received in the groove 43 of an adjacent panel 3*b* to join the panels, as seen in FIG. 3. The side wall 33*a* of the tongue 33 and the side walls 43*a* of the groove 43 are not perpendicular with the end walls 31 and 41 of the tongue side 23 and groove side 25, respectively. The tongue side wall 33*a* forms a slight acute angle $\alpha$ with the panel tongue side end surface 31. The groove side walls 43*a* form a slight acute angle $\beta$, preferably of about 85°, with the panel groove side end wall 41. As shown in FIG. 3, when the two adjacent panels 3*a,b* are assembled together, a screw 45 can be passed through one surface of the panel 3*a* to pass through the groove 43 of the panel 3*b* and the tongue 33 of the panel 3*a*.

Figure 4:
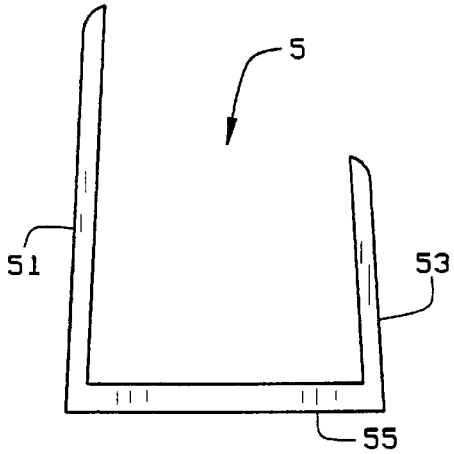
FIG. 4 is an end elevational view of a bottom channel member of the assembly.

The bottom channel member 5 (FIG. 4) has a back leg 51 and a front leg 53 joined by a bottom surface 55 extending between the back and front legs 51 and 53. The front and back legs 51 and 53 are spaced apart a distance approximately equal to the width of the panel 3 so that the panel 3 will fit snugly in the bottom channel 5. The front leg 53 is shorter than the back leg 51. Preferably, the front and back legs are both offset from the vertical, and are angled slightly toward each other. The bottom channel member legs are sufficiently thin so that they can flex during installation of the panel 3 in the channel member 5. The bottom channel member 5 will thus grip the wall panel 3 when the panel is placed in the channel member 5.

In an alternative embodiment (FIG. 7), the bottom channel member 5' includes a heel 59 extending beyond the bottom channel member back leg 51'. The heel 59 is a continuation of the bottom surface 55'.

Figure 5:
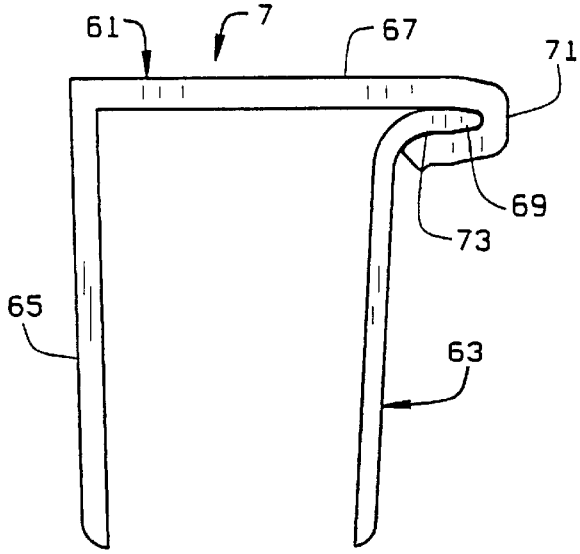
FIG. 5 is an end elevational view of a two-piece top channel member of the assembly.
Figure 6A:
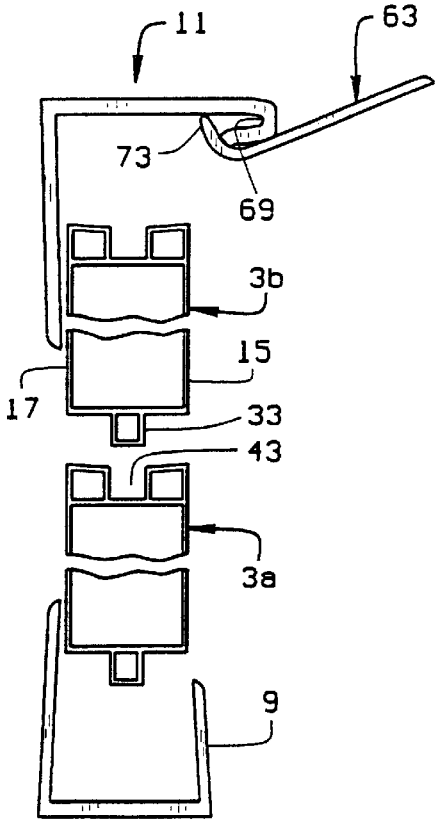
FIGS. 6A–C are top plan views showing the assembly of the wall panel system.
Figure 6B:
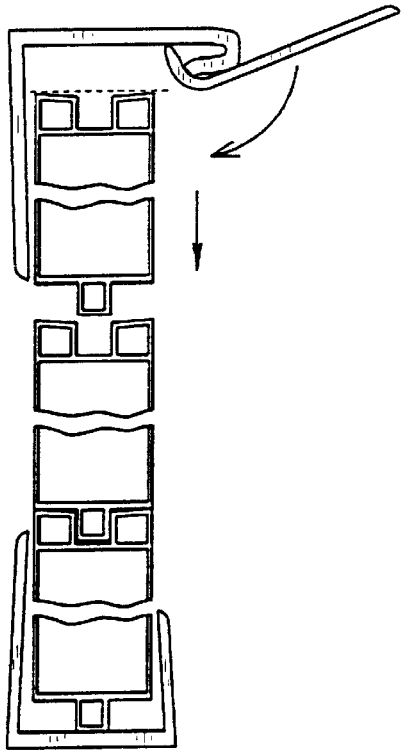
Figure 6C:
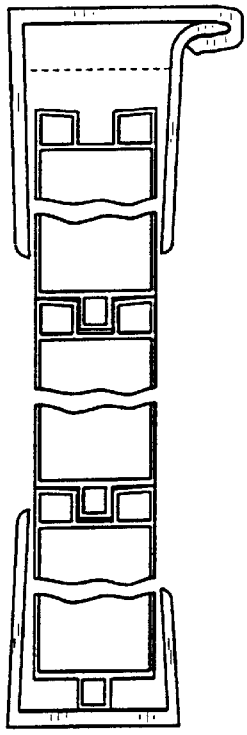

The top channel member 7, shown in detail in FIG. 5, is a two-piece assembly including a fixed member 61 and a pivotable locking leg 63. The fixed member 61, as described below, is mounted to the ceiling of the room in which the panel system is installed to be above the bottom channel member 5. The top and bottom channel members thus define a generally vertical plane. The fixed member 61 is generally in the shape of an angle bracket and includes a back wall 65 and a top wall 67. The back leg 65 can be formed so that it is not perpendicular to the fixed member top wall 7. As seen in FIG. 5, the fixed member back leg 65 forms an acute angle (slightly less than 90°) with the fixed member top wall 67. The top wall 67 includes a rearwardly facing groove 69 at its front end 71. The groove 69 extends the length of the top channel member 7. The pivotable locking leg 63 has a finger 73 which extends from the top of the pivotable locking leg 63 and is sized to be received in the groove 69 of the fixed member 61, so as to be able to pivot from a raised position in which the top channel member is substantially open along its front as seen in FIG. 6A to a lowered position in which the top channel member is closed along its front as seen in FIG. 6C and the locking leg 63 is generally parallel to the fixed member back leg. Thus, as can be appreciated, the top channel member 7 does not really define a true channel until the locking leg 63 is pivoted to, or otherwise placed in, its lowered position.

As noted above, the side channel members 9 and 11 are identical to the top channel member 7, and thus are not described. If desired, one of the side channel members can be identical to the bottom channel member 5, as seen in FIGS. 6A–C.

To assemble and install a wall, divider, etc. using the panel system 1, the bottom channel member 3 is secured to the floor F of the building in which the wall is being installed. A fastener 57 (FIG. 7) is driven through the bottom channel member 5 and into the floor F to anchor the channel member 5 in place. Preferably, the fastener 57 is a corrosion resistant screw-type anchor. When the bottom channel 5 is used the fastener 57 is driven through the channel member bottom 55. When the bottom channel member 5' is used, the fastener 57 is driven through the heel 59. The fixed member 61 of the top channel 7 is anchored to the ceiling above the bottom channel so that the bottom and top channel members are in the same plane. A sufficient number of top and bottom channel members are anchored in place to extend the full length of the wall to be built. If the wall to be built will extend between two other walls, the sides of the wall to be built are framed in with the side channel members 9 and 11. Thus, the side channels 9 and 11 are mounted to the walls between which the wall to be erected will extend. One of the side channel members is identical to the top channel member 5. The other channel member can be identical to either the bottom or top channel members.

Once the channel members are in place, panels 3 are inserted in place. To install the panels, a first panel 3 is held at a low angle with its bottom edge over the bottom channel front leg 53 and extending into the bottom channel member. The panel 3 is then tilted to a vertical position, so that the panel 3 is fully received in the bottom channel member 5. The panel 3 is inserted into the top channel member through the open front of the top channel member. The top of the panel 3 should then be in contact with the top channel member back leg 65. The top of the panel 3 need not extend all the way to the top channel upper surface 67. All that is necessary is that it overlap the top channel member back leg 65. This first panel is then urged along the bottom channel member 5 so that the side of the panel 3 will be received in the side channel member 9.

After the first panel is urged into the side channel member 9, the pivotal locking leg 63 of the first side channel is pivoted until it lies against the front surface 15 of the wall panel 3. Fasteners are then driven through the front wall 55 into the wall panel 3 to secure the wall panel 3 in place. If fasteners, such as screws, bolts, etc., are to be used, a piece of lumber should be inserted in the appropriate chamber 29 of the panel for the screw to be driven into. The pivotal locking leg can be positioned relative to the fixed member either before the panel 3 is erected into place, or after the panel 3 is erected. The assembly of the wall system 1 is described using top channel member for the side channel member 9. However, a bottom channel member could also be used for the first side channel member 9. For reasons which will become apparent below, the a top channel member is used for the second side channel member 11.

Although the locking leg 63 of the second channel member is separate from the fixed member 61, the two portions of the top channel 7 could be formed as a single piece, with the locking leg 63 pivotally attached, for example, by a living hinge, to the fixed member.

With the first panel 3*a* in place, a second panel 3*b* is installed in the same manner. It is inserted into the bottom channel and rotated up into place. It is then slid in the bottom channel so that the tongue 33 and groove 43 of two adjacent panels mate. After several panels have been erected, the first section of the pivotal locking leg 63 is installed in the top channel fixed member 61. This is done substantially in the same way as just described with the side channel member 9. The finger 73 of the pivotal locking leg is inserted in the fixed member groove 69 and rotated down until it lies against the front surface 15 of the panels. Screws 45 are then driven through the pivotal locking leg 63 at each tongue and groove connection, as seen in FIG. 3, to secure the wall panels in place relative to each other.

This process of installing panels 3 and the pivoting leg 63 of the top channel member is continued until the panels extend to the second side channel member 11. After the last panel 3 has been installed in the bottom channel member 5, the pivoting leg 63 of the side channel member 11 is inserted in place in the same manner as the pivoting leg 63 of the top channel members 7 and the first (or right) side channel member 9. Because the last panel to be inserted will not be able to be slid along the bottom channel a distance greater than the length of the bottom channel legs, the second side channel member 11 is made from the top channel member. Then, when the last panel is raised to its vertical position, the side surface of the panel 3 will rest against the back leg 65 of the top channel member 7 and the side channel member 11. The locking legs for the top and side channel members 7 and 11 can then be installed to finish the wall.

If other walls or gates will be mounted to the wall being erected, pieces of lumber (i.e., 2×4's) should be inserted in the appropriate chambers 29 of the panels 3 before the panels are inserted in the bottom channels 5.

Figure 7:
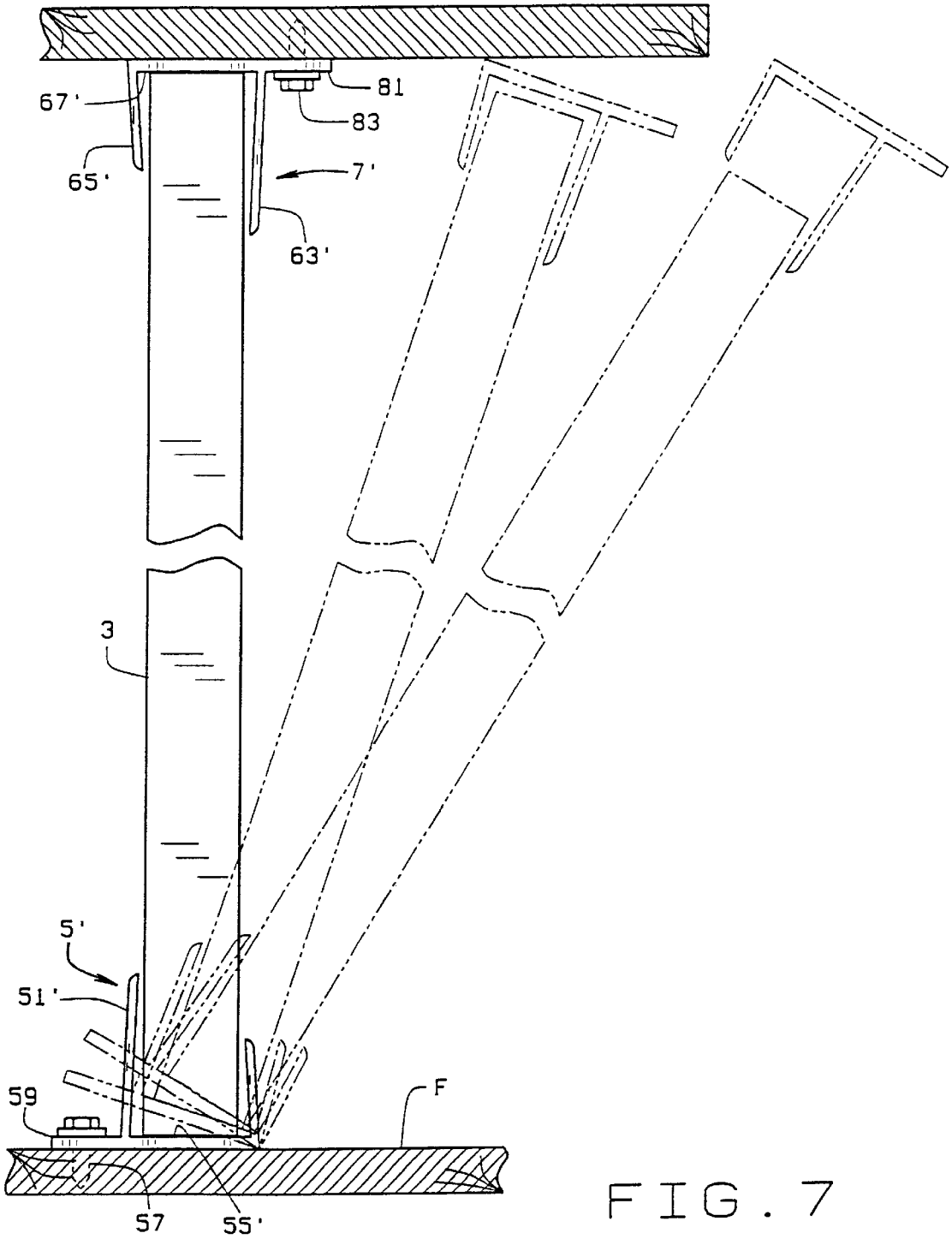
FIG. 7 is an elevational view of the wall panel used with alternate bottom and top channels messages, the figure showing, in phantom lines, a panel being erected.

An alternative one piece top channel member 7' is shown in FIG. 7. The top channel member 7' is substantially identical to the bottom channel member 5'. It includes a back leg 65', a front leg 63', and a top surface 67' extending between the front and back legs. The top surface 67' extends forwardly the front leg 63' to form a heel 81 through which a fastener 83 is driven to anchor the top channel 7' to the ceiling. If the top channel member 7 is used, the fastener is driven through the top surface 67.

Assembly of a wall using the top channel member 7' is shown in FIG. 7. Initially, the bottom and top channel members are mounted to the bottom and top edges of the wall panel. When in a vertical position, the fastener is driven through the heels 59 and 81 of the bottom and top channel members 5' and 7' to secure the panel in place. Alternatively, the bottom channel member can be initially secured in place. The panel, with the top channel member mounted thereto, can then be inserted in the bottom channel member and pivoted up to a vertical position. The top channel member can then be secured to the ceiling.

An alternative two-piece top channel 7B is shown in FIGS. 8A–8E. The top channel 7B includes fixed member 61B and a locking leg 63B. The fixed member 61B, which is fixed to the ceiling or wall to frame in the top or sides of the panels, includes a back leg 65B and a top 67B. The top 67B includes a pair of generally parallel grooves 69A and 69B. The grooves 69A,B face rearwardly and preferably extend substantially the full length of the fixed member 61B. The locking leg 63B is snap-locked in the grooves of the top 67B. The pivoting leg 63B is generally U-shaped. It has a front arm 83 and a back arm 85 joined by a curved bottom 86. Each arm has a forwardly extending finger 87, 89 at its top. The locking leg 63B is formed of PVC, and its arms 83 and 85 are flexible.

Figures 8A, 8B, 8C, 8D, 8E:
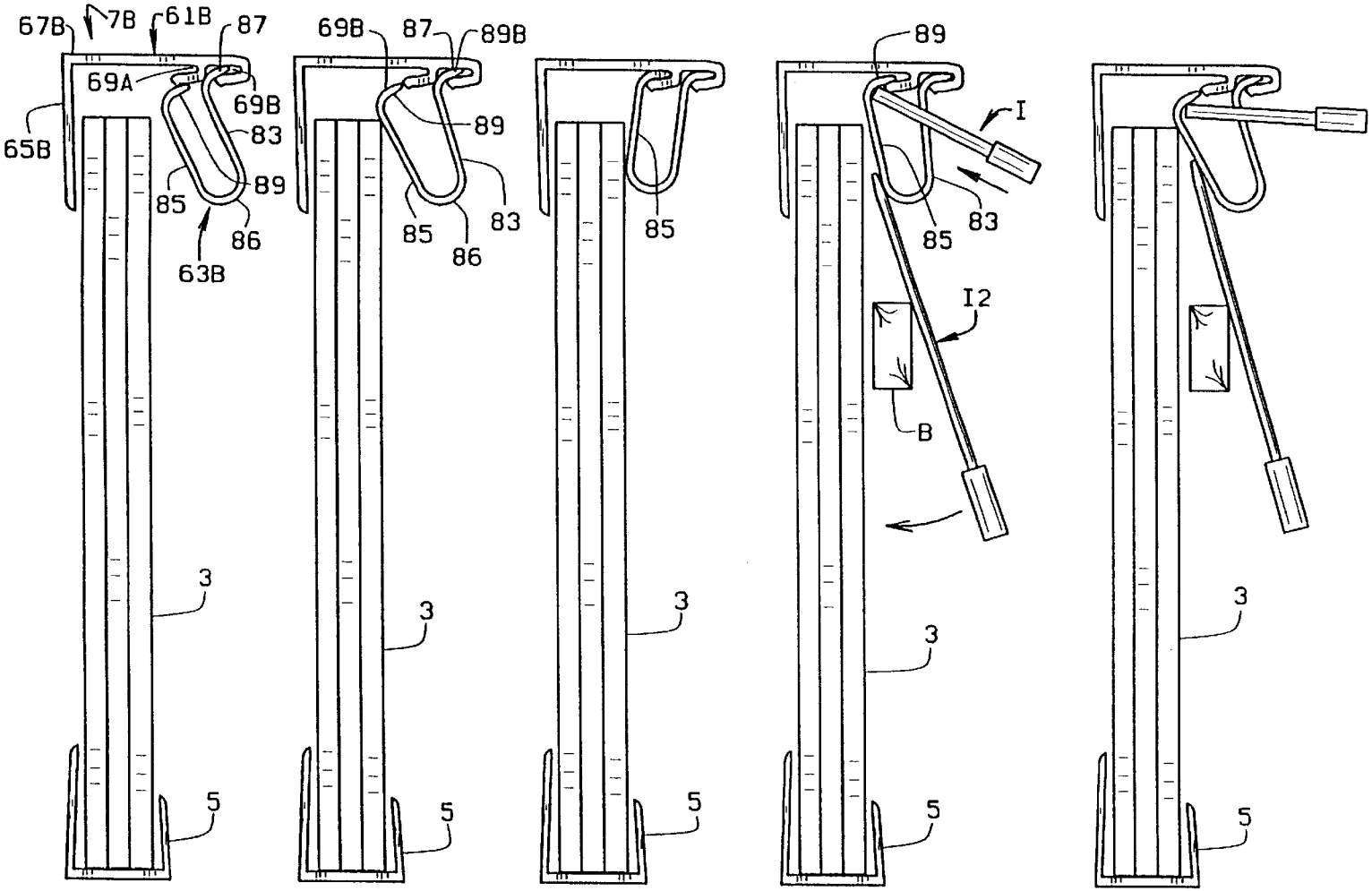
FIGS. 8A–E are elevational views showing the assembly of the wall panel system with a second alternative top channel member.

Application of the locking leg 63B is shown in FIGS. 8A–C. After the panel 3 has been raised to its vertical position, the finger 87 of the forward arm 83 is urged into the forward groove 69B. The finger 89 of the back arm 85 is then urged into the back groove 69A. As seen in FIGS. 8A–E, there is a gap between the top edge of the panel 3 and the top 67B of the top channel member 7B. This gap allows the back arm 85 to extend into the gap above the panel 3, as seen in FIG. 8B, so that the back arm finger 89 can be urged into the rear groove 69A. When the locking leg 63B is installed in the channel member top surface 67B, the locking leg back arm 85 butts up against the panel 3, as seen in FIG. 8C. The construction of the locking leg 63B substantially prevents the locking leg 63B from pivoting relative to the panel 3 and the top surface 67B. Thus, no fasteners are needed, as with the ceiling member 7 of FIG. 5.

Because no fasteners are needed to secure the locking leg 63B in the top channel fixed member 61B, the locking leg 63B can be easily removed from the top channel member 7B to allow for removal of the panel 3 when necessary. To remove the locking leg, 63B, an instrument I, such as a screwdriver, awl, etc. is pushed through the locking leg front arm 83 and is used to push against the back arm 85 to push the back arm finger 89 out of engagement with the fixed member back groove 69A. The instrument I can be inserted through pre-existing holes in the locking leg front arm 83, or the holes can be formed when they are needed. A second instrument 12, such as a screw driver or similar tool, is used to pry or pivot the locking leg back arm 85 downwardly so that the finger 89 will not reengage the rear groove 69A. A block B is preferably used as a pivot point for the instrument 12. This will provide for better leverage, and will reduce the possibility of marring the panel 3 with the instrument 12. Once the locking leg back arm 85 is disengaged from the groove 69A, the front arm can be easily disengaged from the front groove 69B, and the locking leg 63B can be removed from the fixed member 61B. With the locking leg 63B removed, the panel 3 can be tilted forward and removed from the bottom channel member.

There is a lot of dirt and dust in a hog house. Some of this dirt and dust accumulates in the bottom channel. Thus, it is desirable to periodically remove the panels 3 to thoroughly clean the bottom channel members. The panels also need to be removed when they are broken, whether by machinery or by animals. Further, if the hog house is to be repartitioned, the walls will need to be taken down. As can be appreciated, the use of locking leg 63B does not require the removal of a plurality of fasteners, which will make removal of the locking leg faster and easier than if the locking leg 63 of the top channel 7 were used. Because the locking leg 63B can be removed quickly and easily, the wall assembly I can be disassembled fairly quickly and easily.

Figure 9C:
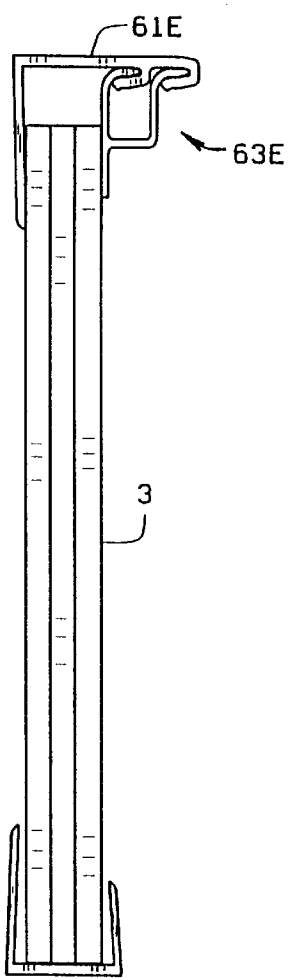
FIGS. 9A–C are elevational views showing other alternative top channels members.
Figure 9B:
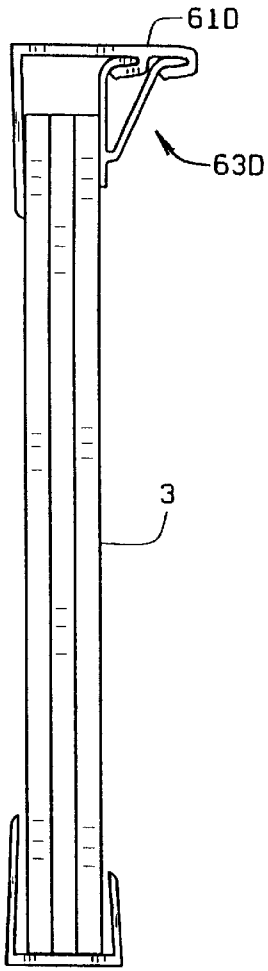
Figure 9A:
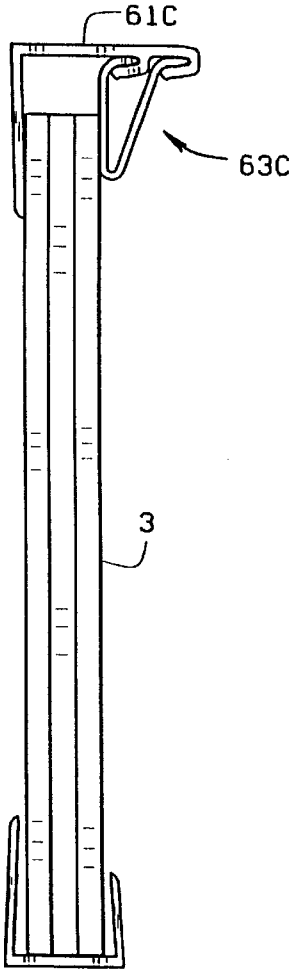

Variations of the top channel 7B are shown in FIGS. 9A–9C. In these variations, the fixed portions 61C–E are substantially the same as the fixed portion 61B of FIGS. 8A–E. The only item that is changed is the configuration of the locking leg. Despite the variations, the operation of the locking legs of FIGS. 9A–9C is the same as that of the locking leg 57B of FIG. 8A. In FIG. 9A, the locking leg 63C is generally "V"-shaped. In FIG. 9B, the locking leg 63D is generally "y"-shaped. Lastly, in FIG. 9C, the locking leg 63E is generally "4"-shaped. The shape of the locking leg 63E can also be described to be generally in the shape of an inverted, reversed "h". The locking legs 63B–E all have a front arm and a back arm with forwardly extending fingers which are received in the grooves of the top channel fixed member. The locking leg could take on any other desired shape that would include a front arm and a back arm.

As can be seen, the wall panel system of the present invention can be used to fairly easily and quickly erect walls in a room to subdivide a room. The walls made from the system are constructed fully of a sturdy plastic, such as PVC, and can be easily cleaned. Further, the walls can be fairly easily taken down, either for cleaning or for repartitioning the room.

As various changes could be made in the above constructions without departing from the scope of the invention, it is intended that all matter contained in the above description or shown in the accompanying drawings shall be interpreted as illustrative and not in a limiting sense. For example, the pivotal connection between the front wall 55 and the top wall 57 of the top channel member 51 can be made with a forwardly facing groove, rather than a rearwardly facing groove. The groove could be circular (or any other desired shape) and the front wall finger would be shaped correspondingly to be received in the groove. Alternatively, the groove 69 could be formed on the locking leg 63, and the front edge 71 of the top channel fixed member 63 would be shaped to be received in the groove. Although the panels 3 are essentially hollow, they can be made solid if desired. This, of course would increase the cost and weight of the panels. These examples are merely illustrative.

What is claimed is:

1. A wall panel system for forming walls comprising;

a panel including a first surface, a second surface, a top edge, side edges, and a bottom edge; and a channel member sized to receive the one of said edges of the panel; the channel comprising a fixed portion and a locking leg; the fixed portion including a back leg of the channel member and the locking leg defining a front leg of the channel member; the locking leg being pivotal relative to the fixed portion between a first position in which said locking leg extends away from said fixed portion back leg such that said channel member is substantially open along its front such that said panel can be inserted into said channel member through its opened front to be positioned against said fixed portion back leg, and a second position in which said panel is sandwiched between said fixed portion back leg and said locking leg.

2. The wall panel system of claim 1 wherein the channel fixed member includes a first groove extending along the channel member upper surface; the locking leg including a finger which engages the fixed member groove.

3. The wall panel system of claim 2 wherein the channel member includes a second groove in the upper surface extending generally parallel to the first groove; the channel member locking leg including an outer arm having a first finger which engages the first groove and a second arm having a second finger which engages the second groove; the locking leg being snapped into place in the channel member fixed member.

4. The wall panel system of claim 3 wherein the channel member locking leg is generally "U"-shaped.

5. The wall panel system of claim 3 wherein the channel member locking is generally "V"-shaped.

6. The wall panel system of claim 3 wherein the channel member locking is generally "h"-shaped.

7. A wall panel system for forming walls comprising;

a panel including a first surface, a second surface, a groove side having a groove, a tongue side opposite the groove side and having a tongue, a top edge, and a bottom edge; said tongue and groove extending substantially the full length of the tongue and groove sides and being sized so that the groove of a first panel can receive the tongue of a second panel;

a bottom channel member sized to receive the bottom edge of the panel; and a top channel member sized to receive the top edge of the panel; the top channel member having a back wall, a front wall, and an upper surface extending between the back and front wall; the top channel member being a two-piece assembly including a fixed member and a locking leg mountable to the fixed member; the fixed member comprising the top channel member back wall and at least a portion of the top channel member upper surface; the locking leg comprising the top channel member front wall.

8. The wall panel system of claim 7 wherein the panel is generally hollow; said panel including dividers which define chambers extending between the top and bottom edges of the panel; the chambers being sized to slidably receive a board.

9. The wall panel system of claim 7 wherein the panel tongue side includes an end surface from which the tongue extends, the tongue having side walls; the tongue side walls defining an angle with the end surface of the panel tongue side; and the groove side of the panel including an end surface in which the groove is formed; the groove having side walls; the groove side walls defining an acute angle with the end surface of the panel groove side.

10. The wall panel system of claim 7 wherein the bottom channel member has a back leg, a front leg, and a bottom surface extending between the back and front legs.

11. The wall panel system of claim 10 wherein the bottom channel member front and back legs are angled toward each other.

12. The wall panel system of claim 11 wherein the bottom channel member bottom surface extends beyond the bottom channel member back wall to define a heel through which a fastener can be driven to anchor the bottom channel member to a surface.

13. The wall panel system of claim 7 wherein the top channel member front and back walls are angled toward each other.

14. The wall panel system of claim 7 including a first side channel member and a second side channel member.

15. The wall panel system of claim 14 wherein the second side channel member is identical to the top channel member.

16. The wall panel system of claim 15 wherein the first side channel member is identical to one of the top and bottom channel members.

17. A wall panel system for forming walls comprising;

a panel including a first surface, a second surface, a groove side having a groove, a tongue side opposite the groove side and having a tongue, a top edge, and a bottom edge; said tongue and groove extending substantially the full length of the tongue and groove edges and being sized so that the groove of a first panel can receive the tongue of a second panel;

a bottom channel member sized to receive the bottom edge of the panel; and a top channel member sized to receive the top edge of the panel; the top channel member including a first portion having a back wall and a top wall and a second portion which is pivotally connected to the first portion; the top channel member second portion being separate from the top channel member first portion; the first portion including a groove and the second portion including a finger which is received in the groove.

18. A method of assembling a wall, the wall comprising one or more panels, a top channel member which receives a top edge of the panel and a bottom channel member which receives a bottom edge of the panel; the top channel member including a fixed portion having a back surface and a locking portion pivotal relative to the fixed portion; the bottom channel member having a back leg, a front leg, and a bottom surface extending between front and back legs; the method comprising:

(a) anchoring the bottom channel member to a floor;

(b) anchoring the top channel member to a ceiling above the bottom channel member so that the top and bottom channel members define a generally vertical plane;

(c) inserting a panel into the bottom channel member;

(d) pivoting the panel up to a generally vertical position so that the panel rests against the back surface of the top channel member;

(e) pivoting the locking portion of the top channel member downwardly;

(f) securing the panel in the generally vertical position using the top channel member; and (g) repeating steps (c)–(f) until the wall-to-be-erected is complete.

19. The method of claim 18 wherein the step of securing the panel includes driving fasteners through the top channel member locking leg and into the panel.

20. The method of claim 19 wherein the panels include mating tongues and grooves; the step of driving the fasteners into the panel comprising driving the fasteners through the junction of adjacent panels, such that the fasteners are driven through the tongue and groove of adjacent panels.

21. The method of claim 18 wherein the locking leg includes a front arm and a back arm, each arm of the locking leg having a finger; the top channel fixed member including a pair of generally parallel grooves which receive the locking leg fingers; the step of mounting the locking leg to the top channel fixed member comprising inserting the locking arm fingers into the top channel grooves.

22. The method of claim 21 wherein the step of securing the panel in the vertical position comprises inserting the locking arm fingers into the top channel grooves; the panel being secured without the use of fasteners.

23. A channel member for use in assembling a wall made of two or more panels; the channel member having a back wall, a front wall, and an upper surface extending between the back and front wall; the channel member comprising:

a fixed member mountable to a surface, the fixed member comprising the channel member back leg and at least a portion of the channel member upper surface; and a locking leg comprising the channel member front leg; the locking leg being hingedly connected to the fixed member.

24. The channel member of claim 23 wherein the fixed member includes a first groove extending along the channel member upper surface; the locking leg including a finger which engages the fixed member groove.

25. The channel member of claim 23 wherein the channel member includes a first groove and a second groove in the upper surface; said first and second grooves extending generally parallel to each other; the channel member locking leg including an outer arm having a first finger which engages the first groove and a second arm having a second finger which engages the second groove; the locking leg being snapped into place in the channel member fixed member.

26. The channel member of claim 23 wherein said channel member is a two-piece assembly and said fixed member and locking leg are independent parts of said channel member.

27. A wall panel system for forming walls comprising;

a panel including a first surface, a second surface, a top edge, side edges, and a bottom edge; and a channel member sized to receive one of the edges of the panel; the channel member including a first portion having a back wall and a base wall of the channel member and a second portion which includes a front wall of the channel member; the channel member being movable between a first position in which said channel member is substantially open along its front to allow a panel to be positioned against said first portion back wall, and a second position in which said panel is sandwiched between said first portion backwall and said second portion front wall.

28. The wall panel system of claim 27 wherein said second portion is hinged to said first portion.

29. The wall panel system of claim 28 wherein said second portion is separate from said first portion.

30. A channel member for use in assembling a wall made of two or more panels; the channel member having a back wall, a front wall, and a base extending between said front and back walls; the channel member comprising:

a first member mountable to a surface, the first member comprising the channel member back leg and at least a portion of the channel member base; the first member including a groove in the base; and a second member comprising the channel member front leg; the second member including a portion which engages the first member groove.

* * * * *